US006809073B2

(12) United States Patent
Höflinger et al.

(10) Patent No.: US 6,809,073 B2
(45) Date of Patent: Oct. 26, 2004

(54) METHOD OF PRODUCING A MULTI-LAYER DETERGENT TABLET

(75) Inventors: Wilfried Höflinger, Schriesheim (DE); Laurence Geret, Ludwigshafen (DE); Brigitte Sandmann, Heidelberg (DE); Ralf Wiedemann, Griesheim (DE)

(73) Assignee: Reckitt Benckiser N.V., Hoofddorp (NL)

( * ) Notice: Subject to any disclaimer, the term of this patent is extended or adjusted under 35 U.S.C. 154(b) by 0 days.

(21) Appl. No.: 10/000,641

(22) Filed: Nov. 15, 2001

(65) Prior Publication Data

US 2002/0147125 A1 Oct. 10, 2002

Related U.S. Application Data

(63) Continuation of application No. PCT/EP00/04478, filed on May 17, 2000.

(30) Foreign Application Priority Data

May 17, 1999 (DE) ..... 19 22 578

(51) Int. Cl.[7] ..... C11D 11/00; C11D 17/00

(52) U.S. Cl. ..... 510/446; 510/224; 510/294; 510/298

(58) Field of Search ..... 510/446, 224, 510/294, 298

(56) References Cited

U.S. PATENT DOCUMENTS 4,460,490 A 7/1984 Barford et al.
4,828,749 A * 5/1989 Kruse et al. ..... 510/224
6,274,538 B1 * 8/2001 Addison ..... 510/224
6,339,059 B1 * 1/2002 Appel et al. ..... 510/446

FOREIGN PATENT DOCUMENTS

DE 29823506 U1 * 6/1999
DE 299 11 486 U1 12/1999
EP WO 00/04115 * 1/2000
WO WO 98/55590 A1 12/1998
WO WO 99/06522 * 2/1999

* cited by examiner

*Primary Examiner*—Lorna M. Douyon
(74) *Attorney, Agent, or Firm*—Akin Gump Strauss Hauer & Feld, LLP

(57) ABSTRACT

A method is provided for producing a tablet, especially a detergent tablet, which includes at least one first and one second layer. The method comprises the following steps: (a) introducing a first metered quantity of a first particulate composition into a molding cavity of a tablet press; (b) compacting the first metered quantity with a first mold pressure by means of a molding punch that has at least one convexity on its pressing surface, to produce a first compacted layer that has one or more respective indentations in its upper surface that corresponds to a convexity/convexities on the molding punch; (c) introducing a second metered quantity of a second particulate composition into the molding cavity of the tablet press on top of the first compacted layer; and (d) compacting the second metered quantity with a second mold pressure by means of a molding punch, to produce a second compacted layer with one or more respective indentations in its upper surface.

12 Claims, 1 Drawing Sheet

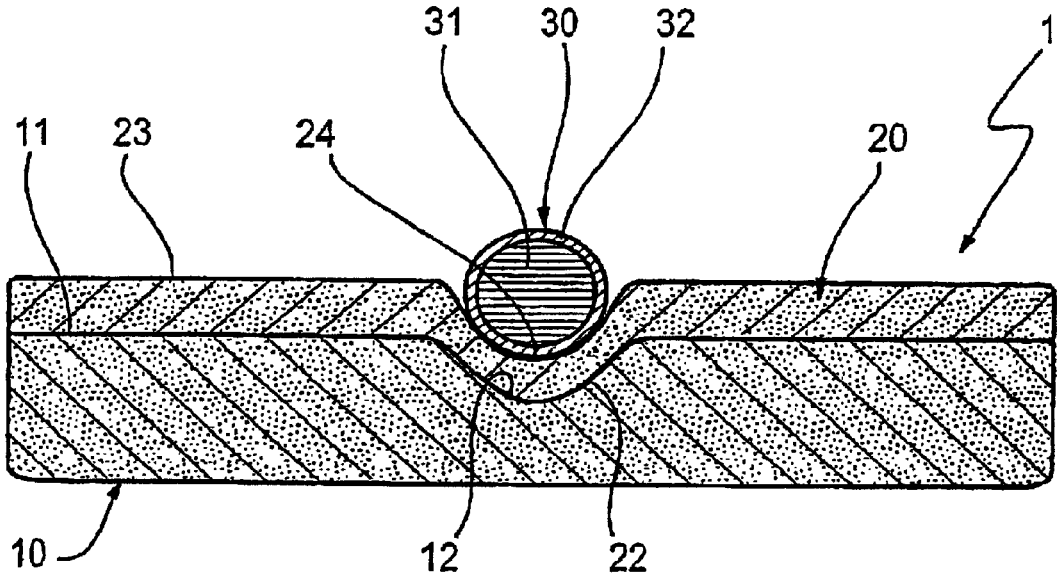
31
30
32
1
11
23
24
20
10
12
22

METHOD OF PRODUCING A MULTI-LAYER DETERGENT TABLET

CROSS-REFERENCE TO RELATED APPLICATIONS

This application is a continuation of International Application No. PCT/EP00/04478, filed May 17, 2000, the disclosure of which is incorporated herein by reference.

BACKGROUND OF THE INVENTION

The invention relates to a method of producing a tablet, in particular a detergent tablet, having at least a first and a second layer, and a product obtained thereby.

In applications involving washing agents and detergents, detergent enhancers, dishwasher detergents, disinfectants, decalcifying agents, etc., tablets have established a place for themselves on the market in recent years as a format that provides easy metering and is simple to use.

Two-layer tablets are also becoming increasingly commonplace, in which different ingredients are divided between the two layers, first as a means of separating substances that are not compatible with one another until the tablet is used, and second as a means of producing different release profiles for the substances contained in them.

These tablets are produced in presses similar to those used for single-layer tablets, although some modifications do have to be made. In the case of a two-layer tablet, a first mixture with a first composition is usually poured into a mold and subjected to a preliminary compacting process at a first pressure. Then, a second mixture having a second, different composition is poured into the mold on top of the first, pre-compacted layer, followed by a final compaction process at a second, usually higher pressure.

The problem which occurs with tablets having at least two layers is that the joint between the individual layers has to be stable enough to prevent the layers coming apart from one another during storage and transportation of the multi-layer tablets. There are numerous reasons why the layers might come apart from one another, e.g., expansion of the volume of the individual layers, reactions at the boundary surface between the layers, etc. It is therefore of crucial importance that the compositions of the individual layers are exactly aligned with one another and that the pressures applied when compressing the individual layers are accurately set. Developing and producing stable, multi-layer tablets is therefore time- and cost-intensive and is also very sensitive to any change in internal and external parameters during the process.

BRIEF SUMMARY OF THE INVENTION

Accordingly, the underlying objective of the invention is to improve the known method so as to produce more stable multi-layer tablets, in which the individual layers are largely prevented from coming apart from one another.

The invention relates to a method of producing a tablet, in particular a detergent tablet, having at least a first and a second layer, comprising the following steps: (a) introducing a first metered quantity of a first particulate composition into a mold cavity of a tablet press; (b) compacting said first metered quantity at a first pressing pressure by means of a molding punch which has at least one convexity on its pressing surface to produce a first compacted layer with an indentation(s) in its top face corresponding to the convexity/convexities on the molding punch; (c) introducing a second metered quantity of a second particulate composition into the mold cavity of the tablet press on top of the first compacted layer; and (d) compacting said second metered quantity at a second pressing pressure by means of a mold punch to produce a second compacted layer with an indentation(s) in its top face. The invention also relates to a product produced by the method.

In one specific embodiment of the method proposed by the invention, steps (c) and (d), respectively, are repeated in order to produce a third and optionally additional layers.

The indentation(s) in the uppermost layer of the tablet produced by the method of the invention is (are) preferably filled. This being the case, there are several possible options, including, for example, filling with a free-flowing, curable composition, introducing and then compacting a particulate composition or introducing one or more molded pieces.

In another embodiment of the invention, if the indentation(s) in the uppermost layer of the tablet is (are) filled with molded pieces, the latter will project above the surface of-the tablet once inserted in the indentation(s). By preference, the molded piece(s) is (are) fixed in the indentation(s) by means of a substance that will produce a transport-resistant joint between tablet and molded piece, which, in a preferred embodiment, will be an adhesive.

The invention also relates to a multi-layer tablet, in particular a detergent tablet, which can be produced using the method proposed by the invention.

BRIEF DESCRIPTION OF THE DRAWINGS

The foregoing summary, as well as the following detailed description of the invention, will be better understood when read in conjunction with the appended drawing. For the purpose of illustrating the invention, there is shown in the drawing an embodiment which is presently preferred. It should be understood, however, that the invention is not limited to the precise arrangements and instrumentalities shown. In the drawing:

The sole FIGURE is a cross-sectional view of one embodiment of the invention, depicting a two-layer tablet with a molded piece fixed in an indentation in the uppermost layer.

DETAILED DESCRIPTION OF THE INVENTION

Surprisingly, it has been found that the method proposed by the invention affords a simple means of strengthening the joint between the individual layers of a multi-layer tablet such that the layers come apart from one another much less frequently during storage and transport. In this respect, the tablet is less sensitive to fluctuations in internal (e.g., composition of the individual layers) and external (e.g., compaction pressures, temperatures, air humidity levels) parameters during the production process. Without wanting to posit any specific theory as to why this should be the case, it is assumed that these stronger joints between the individual layers of the tablet may be at least partially attributable to improved "interlocking" of the layers, as will become apparent from the description given below. Accordingly, by using the method proposed by the invention, the compaction pressures that have been used in the past can now be reduced while nevertheless producing a joint between the individual layers that is at least as good as it was before. Other advantages and features of the invention will become clear from the attached drawing and description given below.

For the purpose of the method proposed by the invention, the bottom layer 10 of the tablet 1 is made first by introducing a first metered quantity of a first particulate composition into a mold cavity of a tablet press, where it is compacted at a first compaction pressure by means of a mold punch with a convexity on its pressing surface, which essentially complements the indentation 12 produced as a result in the uppermost face 11 of the bottom layer 10 of the tablet 1.

Then, on top of the first compacted layer 10, a second metered quantity or a second particulate composition (which is usually different from the first particulate composition) is introduced into the mold cavity of the tablet press and the second layer of the tablet 20 is compacted at a second compaction pressure (which is usually higher than the first compaction pressure) by means of the mold punch. Consequently, the two tablet layers 10 and 20 are not only pressed together along the horizontal boundary layer, but also specifically in the indentation 12 of the bottom layer 10, as a result of which laterally directed pressing forces are also produced, pressing the second composition particularly hard and firmly into the indentation 12 of the bottom layer 10.

A perceptible effect of the strengthening of the joint between the two layers due to the interlock between the indentation 12 of the bottom layer 10 and the convexity 22 of the top layer 20 and the stronger joint of the layers in this region is clearly in evidence using only one mold punch. Clearly, this effect could be further enhanced by providing several convexities in the mold punch. The compaction pressures can therefore be left at levels used as standard to produce two-layer tablets, although these compaction pressures may vary sharply depending on the composition of the individual layers. Compaction pressures for specific compositions will be specified in the examples described below.

The indentations 24 produced in the top face 23 of the top layer 20 by the production process proposed by the invention may be left as they are or are preferably filled with another material, which can simultaneously assume other functions when the tablet is used. In the embodiment illustrated here, a molded piece 30 is fixed by a suitable means, such as an adhesive, for example, in the complementary (at least in its lower part) indentation 24. The molded piece 30 in the embodiment illustrated here is provided in the form of a core 31 and an additional protective coating 32, in order to protect it during storage and to control the release of the substances contained in the core 31 during use.

The compositions of the tablets and molded pieces may be very varied, depending on their use. Different options for preferred applications will be described in the Examples below.

The compositions of the tablets in Examples 1 to 7 are dishwasher detergent compositions, the tablets of Examples 2 to 7 having indentations in the top face of the uppermost layer filled with different molded pieces. Example 8 describes a detergent enhancer tablet and a washing machine tablet.

It would also be conceivable to use multi-layer tablets in other applications—apart from the field of detergents. The skilled person in each individual case will be familiar with or will have developed appropriate formulas and processing methods. In order to carry out the method proposed by the invention, he will merely have to modify the mold punch and optionally compaction pressures accordingly.

Example 1

The table below relates to the composition of the two layers of a two-layer dish washer tablet (weight ratio approximately 50:50) in which layer 1 represents the first (bottom) layer which is only lightly compacted (without being actually compressed) during step (b), which is enough to produce a smooth surface with the requisite indentation in the top face. Once the second composition has been introduced, the final tablet is pressed at a compaction pressure of approximately 100 kN/cm$^2$.

| Tablet | | | |
|---|---|---|---|
| Layer 1 | | Layer 2 | |
| Ingredient | % wt | Ingredient | % wt |
| Sodium tripolyphosphate | 48 | Sodium tripolyphosphate | 50 |
| Sodium carbonate | 24 | Sodium carbonate | 24 |
| Sodium perborate | 16 | TAED | 10 |
| Non-ionic surfactant | 5 | Non-ionic surfactant | 2 |
| Corrosion inhibitor (BTA) | 0.3 | Bleach-resistant cold water-active protease | 4 |
| Sodium disilicate | 5 | Bleach-resistant amylase | 2 |
| Binder, perfume, water | to make up 100 | Polyacrylate | 4 |
| | | Binder, colorant, water | to make up 100 |
| Tablet dissolving time (40° C.): 12 min. (±2 min.) | | | |

Examples 2–7

Examples 2 to 7 below also relate to two-layer dish washer tablets, the composition in the individual layers of the tablet being modified only slightly from that of Example 1 (if at all). By way of illustration in the individual examples, specific examples of different molded pieces are described, which can be placed in the indentation made in the top face of the uppermost (second) layer and secured with adhesive. The actual method of producing the tablets, in particular the compaction pressures specified in Example 1, remain unchanged.

Example 2

| Tablet | | | | | |
|---|---|---|---|---|---|
| Layer 1 | | Layer 2 | | Molded Piece | |
| Ingredient | % wt | Ingredient | % wt | Ingredient | % wt |
| Sodium tripolyphosphate | 48 | Sodium tripolyphosphate | 50 | Lactose | 43 |
| Sodium carbonate | 24 | Sodium carbonate | 24 | Microcrystalline cellulose | 18 |
| Sodium perborate | 16 | TAED | 10 | Explosive releaser | 2 |
| Non-ionic surfactant | 5 | Non-ionic surfactant | 2 | (polyplasdone) | |
| Corrosion inhibitor (BTA) | 0.3 | Bleach-resistant cold water- | 4 | Phosphonate | 6 |
| Sodium disilicate | 5 | active protease | | Bleach-resistant cold | 25 |

-continued

| Tablet | | | | | |
|---|---|---|---|---|---|
| Layer 1 | | Layer 2 | | Molded Piece | |
| Ingredient | % wt | Ingredient | % wt | Ingredient | % wt |
| Binder, perfume, water | to 100 | Bleach-resistant amylase | 2 | water-active protease | |
| | | Polyacrylate | 4 | Mg stearate | 0.5 |
| | | Binder, colorant, water | to 100 | Colorant | to 100 |
| Tablet dissolving time (40° C.): 12 min. (±2 min.) | | | | Molded piece dissolving time (40° C.): <1 min | |

Because of the rapid dissolving time of the molded piece (<1 min.), the protease contained in it is released more quickly than that contained in the tablet, and its effect can be triggered as early as the start of the main rinsing cycle. When the tablet dissolves during the heating process, fresh enzymes (protease and amylase) are released into the washing liquor again.

Example 3

| Tablet | | | | | |
|---|---|---|---|---|---|
| Layer 1 | | Layer 2 | | Molded Piece | |
| Ingredient | % wt | Ingredient | % wt | Ingredient | % wt |
| Sodium tripolyphosphate | 48 | Sodium tripolyphosphate | 50 | Lactose | 40 |
| Sodium carbonate | 24 | Sodium carbonate | 24 | Microcrystalline cellulose | 18 |
| Sodium perborate | 16 | TAED | 10 | Explosive releaser | 2 |
| Non-ionic surfactant | 5 | Non-ionic surfactant | 2 | (Polyplasdone) | |
| Corrosion inhibitor (BTA) | 0.3 | Bleach-resistant cold | 4 | Phosphonate | 6 |
| Sodium disilicate | 5 | water-active protease | | Bleach-resistant cold | 13 |
| Binder, perfume, water | to 100 | Bleach-resistant cold | 2 | water-active protease | |
| | | water-active amylase | | Bleach-resistant cold | 15 |
| | | Polyacrylate | 4 | water-active amylase | |
| | | Binder, colorant, water | to 100 | Mg stearate | 0.5 |
| | | | | Colorant | to 100 |
| Tablet dissolving time (40° C.): 12 min. (±2 min.) | | | | Molded piece dissolving time (40° C.): <1 min | |

This is the same as Example 1, the difference being that in this case both protease and amylase are released at the start of the main rinsing cycle.

Example 4

The tablet essentially corresponds to that of Examples 1 and 2 in terms of composition, the difference being that protease and amylase that are stable in hot water are used in layer 2 of the tablet. The composition of the molded piece corresponds to that of the molded piece of Example 2.

Because the tablet and molded piece dissolve at different times, the different actions of the different types of protease and amylase occur in the best possible sequence. The molded piece releases cold water-active protease and amylase at the start of the main rinsing cycle. As the tablet dissolves during the heating process, bleach-resistant hot-water resistant enzymes are released into the washing liquor.

Example 5

| Tablet | | | | | |
|---|---|---|---|---|---|
| Layer 1 | | Layer 2 | | Molded Piece | |
| Ingredient | % wt | Ingredient | % wt | Ingredient | % wt |
| Sodium tripolyphosphate | 48 | Sodium tripolyphosphate | 50 | Lactose | 43 |
| Sodium carbonate | 24 | Sodium carbonate | 24 | Microcrystalline cellulose | 18 |
| Sodium perborate | 16 | TAED | 10 | Explosive releaser | 2 |
| Non-ionic surfactant | 5 | Non-ionic surfactant | 2 | (Polyplasdone) | |
| Corrosion inhibitor (BTA) | 0.3 | Bleach-resistant protease | 4 | Phosphonate | 6 |
| Sodium disilicate | 5 | Bleach-resistant amylase | 2 | Lipase | 25 |
| Binder, perfume, water | to | Polyacrylate | 4 | Mg stearate | 0.5 |
| | 100 | Binder, colorant, water | to | Colorant | to |
| | | | 100 | | 100 |
| Tablet dissolving time (40° C.): 12 min. (±2 min.) | | | | Molded piece dissolving time (40° C.): <1 min | |

This embodiment enables lipase and protease that are not compatible in solution to be released at different times.

Example 6

| Tablet | | | | | |
|---|---|---|---|---|---|
| Layer 1 | | Layer 2 | | Molded Piece | |
| Ingredient | % wt | Ingredient | % wt | Ingredient | % wt |
| Sodium tripolyphosphate | 48 | Sodium tripolyphosphate | 50 | Lactose | 40 |
| Sodium carbonate | 24 | Sodium carbonate | 28 | Microcrystalline cellulose | 18 |
| Sodium perborate | 16 | TAED | 12 | Explosive releaser | 2 |
| Non-ionic surfactant | 5 | Polyacrylate | 4 | (Polyplasdone) | |
| Corrosion inhibitor | 0.3 | Binder, colorant, water | to | Phosphonate | 6 |
| Sodium disilicate | 5 | | 100 | Cold water-active protease | 13 |
| Binder, perfume, water | to | | | Cold water-active amylase | 15 |
| | 100 | | | Mg stearate | 0.5 |
| | | | | Colorant | to |
| | | | | | 100 |
| Tablet dissolving time (40° C.): 12 min. (±2 min.) | | | | Molded piece dissolving time (40° C.): <1 min | |

This embodiment enables bleaching agents to be dissolved at a different time from enzymes that are not compatible with bleaching agents in solution.

Example 7

| Tablet | | | | | |
|---|---|---|---|---|---|
| Layer 1 | | Layer 2 | | Molded Piece | |
| Ingredient | % wt | Ingredient | % wt | Ingredient | % wt |
| Sodium tripolyphosphate | 58 | Sodium tripolyphosphate | 55 | Lactose | 30 |
| Sodium carbonate | 24 | Sodium carbonate | 28 | Explosive releaser | 2 |
| Bleach resistant protease | 3 | Bleach-resistant amylase | 2 | (Polyplasdone) | |
| Non-ionic surfactant | 5 | Noniionic surfactant | 2 | Peracid (phthalimido- | 60 |
| Corrosion inhibitor | 0.3 | Phosphonate | 4 | peroxy-caproic acid) | |
| Sodium disilicate | 5 | Polyacrylate | 4 | Mg stearate | 0.5 |
| Binder, perfume, water | to | Binder, colorant, water | to | Colorant | to |
| | 100 | | 100 | | 100 |
| Tablet dissolving time (40° C.): 12 min. (±2 min.) | | | | Molded piece dissolving time (40° C.): <1 min | |

By dissolving the molded piece at the start of the main rinsing cycle, the peracid will be able to act under the requisite acid conditions when released. By dissolving the tablet later, the usual optimum alkaline rinsing conditions for protease and amylase are obtained.

Example 8

The table below gives an example of a formula for a two-layer detergent enhancer tablet. The first (bottom) layer in this case represents approximately 74% by weight of the total tablet while the second (top layer) represents approximately 26%.

| Ingredient | 1st (bottom) layer % by weight | 2nd (top) layer % by weight |
|---|---|---|
| Sodium percarbonate | 76.00 | — |
| Citric acid | 5.00 | 17.50 |
| Microcrystalline cellulose | 7.00 | 7.00 |
| Laminated silicate | 5.00 | 5.00 |
| Enzyme | — | 5.00 |
| Sodium bicarbonate | 1.50 | 10.00 |
| TAED | — | 50.00 |
| Polyethylene glycol 6000 | 4.00 | 4.00 |
| Polyvinyl pyrrolidone | 1.50 | 1.50 |

The table below gives an example of a formulation for a detergent tablet, the two layers in this case being in a weight ratio of 70 (bottom (1st) layer) to 30 (top (2nd) layer).

| Ingredient | 1st (bottom) layer | 2nd (top) layer |
|---|---|---|
| Linear alkylbenzene sulphonate | 12.50 | 13.00 |
| Soap | 1.25 | 1.20 |
| Alkyl sulphate | 2.05 | 3.50 |
| Phosphonate | 0.50 | 1.00 |
| Polymer | 2.30 | 2.30 |
| Zeolite | 5.50 | 6.50 |
| Sodium carbonate | 19.00 | 17.00 |
| Carboxymethyl cellulose | 0.30 | 0.30 |
| Sodium sulfate | 3.00 | 2.74 |
| Sodium silicate | 2.00 | 1.00 |
| Amorphous silicate | 8.00 | 13.00 |
| Anti-foaming agent | 0.50 | 0.30 |
| Disintegrating agent | 10.00 | 10.00 |
| Polyethylene glycol | — | 1.00 |
| Colorant | — | 0.01 |
| Protease | — | 2.70 |
| Amylase | — | 1.70 |
| Percarbonate | 30.00 | — |
| TAED | — | 18.00 |
| Optical brightener | 0.30 | 0.25 |
| Perfume | 0.30 | — |
| Water | 2.50 | 4.50 |
| | 100.00 | 100.00 |

Various options will now be described for the molded pieces which may be used in conjunction with the two-layer detergent enhancer tablets or detergent tablets described above.

a. Molded Piece for the Controlled Release of Acid During the Rinsing Cycle

The purpose of releasing an acid into the rinsing cycles of a washing machine is both to remove incrustations and to neutralize alkaline residues. Advantageouasly, weak acids are used for this purpose, such as amidosulphonic acid and/or maleic acid. These materials are usually solids. The production method is as follows: A mixture of 1.05 g of amidosulphonic acid and 0.45 g of maleic acid are molded in a rotary press at a pressure of 890 kg/cm$^2$.

b. Molded Piece for the Controlled Release of a Perfume into the Rinsing Cycle

Taking account of the same considerations as those described in Example 7a, an appropriate molded piece is produced as follows: 0.1975 g of perfume are absorbed on 0.0525 g of fine particulate silicic acid to produce a free-flowing granular material. The resultant 0.25 g are admixed with 0.6 g of microcrystalline cellulose and 0.15 g of cross-linked polyvinyl pyrrolidone. The mixture is tabletted in a rotary press with an internal diameter of 10 mm at a pressure of 2900 kg/cm$^2$ to produce an elliptical molded piece with a height of 13.1 mm weighing approximately 1 g.

c. Molded Piece for the Controlled Release of Chlorine Bleach During the Rinsing Cycle Chlorine bleach is used during the rinsing cycles of a washing machine to improve the cleansing effect and simultaneously provide an additional disinfecting action. Taking account of the considerations described in Examples 7*a* and 7*b,* molded pieces for this purpose can be produced as follows: 1 g of chlorine bleach, e.g., pure sodium dichloroisocyanurate, may be compressed to produce a molded piece in an appropriate press at a pressure of 5,600 kg/cm$^2$.

d. Molded Piece for the Controlled Release of Fabric Conditioning Agents During the Rinsing Cycle.

In this example, the molded piece contains several substances which are intended to produce their respective effects during the rinsing cycle of a washing machine. Specifically, this will be a combination of a softening rinse, an agent to reduce the build-up of static electricity in the fabric, and an agent to improve the renewed moisture uptake by the fabric.

A slurry of 58% urea, 18% dimethyl distearyl ammonium chloride (DMDSAC) (90%), 8% of a $C_{9-11}$-alcohol ethoxylated with 9 mol ethylene oxide and 16% water was produced. The slurry was spray-dried to produce a granular material with a density of 580 g/l and obtain the following composition: 68.8% by weight urea, 19.2% by weight DMDSAC, 9.5% by weight non-ionic surfactant and 2.5% by weight water.

4 g of the granular composition were admixed with 1 g of cellulose. The mixture was tabletted in a rotary press with an internal diameter of 25 mm and a pressure of 80 kg/cm$^2$ to produce an elliptical molded piece with a height of 14 mm weighing 5 g.

Stability tests, during which mechanical stress, such as occurs during transportation, was simulated, demonstrated that the tablets produced as outlined in the Examples above have a measurably improved stability if made at the same pressing pressures as would normally be used to produce two-layer tablets.

The characterizing features of the invention disclosed in the above description, accompanying drawing and the following claims may essentially be used individually or in any combination to carry out the invention in its different embodiments.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

We claim:

1. A method of manufacturing a tablet with at least a first and a second layer, comprising the following steps:

a) introducing a first metered quantity of a first particulate composition into a mold cavity of a tablet press;

b) compacting the first metered quantity at a first pressing pressure by a mold punch having at least one convexity on its pressing surface in order to produce a first compacted layer which has at least one indentation in its top face corresponding to the at least one convexity on the mold punch;

c) introducing a second metered quantity of a second particulate composition into the mold cavity of the tablet press on top of the first compacted layer; and d) compacting the second metered quantity at a second pressing pressure by the mold punch to produce a second compacted layer with at least one corresponding indentation in its top face.

2. The method of claim 1, wherein steps (c) and (d) respectively are repeated in order to produce a third layer and optionally other layers.

3. The method of claim 1, wherein the at least one indentation in an uppermost layer of the tablet is filled.

4. The method of claim 3, wherein the at least one filled indentation is filled by introducing a free-flowing, curable composition.

5. The method of claim 3, wherein the at least one filled indentation is filled by introducing and then pressing a particulate composition.

6. The method of claim 3, wherein the at least one filled indentation is filled by inserting at least one molded piece.

7. The method of claim 6, wherein the at least one molded piece projects above the surface of the tablet when placed in the at least one indentation.

8. The method of claim 6, wherein the at least one molded piece is fixed in the at least one indentation with a substance which produces a transport-resistant joint between the tablet and the at least one molded piece.

9. The method of claim 8, wherein the at least one molded piece is fixed in the at least one indentation with an adhesive.

10. The method according to claim 1, wherein the tablet is a detergent tablet.

11. A multi-layer tablet produced according to claim 1.

12. The multi-layer tablet of claim 11, wherein the tablet is a detergent tablet.

* * * * *

UNITED STATES PATENT AND TRADEMARK OFFICE

CERTIFICATE OF CORRECTION

PATENT NO. : 6,809,073 B2 
DATED : October 26, 2004
INVENTOR(S) : Wilfried Höflinger et al.

It is certified that error appears in the above-identified patent and that said Letters Patent is hereby corrected as shown below:

Title page,
Item [30], Foreign Application Priority Data, number should read -- 199 22 578 --.

Signed and Sealed this

Second Day of August, 2005

JON W. DUDAS
*Director of the United States Patent and Trademark Office*